US006031918A

United States Patent [19]

Chahabadi

[11] Patent Number: 6,031,918

[45] Date of Patent: Feb. 29, 2000

[54] DEVICE FOR CONTROLLING THE VOLUME OF A CAR RADIO AS A FUNCTION OF DRIVING NOISE

[75] Inventor: Djahanyar Chahabadi, Hildesheim, Germany

[73] Assignee: Blaupunkt-Werke GmbH, Hildesheim, Germany

[21] Appl. No.: 08/793,667

[22] PCT Filed: Aug. 16, 1995

[86] PCT No.: PCT/DE95/01071

§ 371 Date: Feb. 27, 1997

§ 102(e) Date: Feb. 27, 1997

[87] PCT Pub. No.: WO96/07293

PCT Pub. Date: Mar. 7, 1996

[30] Foreign Application Priority Data

Aug. 31, 1994 [DE] Germany ..... 44 30 931

[51] Int. Cl.[7] ..... H04R 25/00

[52] U.S. Cl. ..... 381/94.1; 381/57; 381/86

[58] Field of Search ..... 381/57, 107, 86, 381/94, 94.1, 98; 455/238.1

[56] References Cited

U.S. PATENT DOCUMENTS

| | | | |
|---|---|---|---|
| 4,196,528 | 4/1980 | Foers | 35/11 R |
| 4,558,460 | 12/1985 | Tanaka et al. | 381/86 |
| 4,868,881 | 9/1989 | Zwicker et al. | 381/57 |
| 4,930,862 | 6/1990 | Miers et al. | 350/96.29 |
| 4,958,519 | 9/1990 | Whaley | 73/505 |
| 5,069,071 | 12/1991 | McBrien et al. | 73/654 |
| 5,355,419 | 10/1994 | Yamamoto et al. | 381/57 |
| 5,483,692 | 1/1996 | Person et al. | 425/238.1 |
| 5,796,006 | 8/1998 | Bellet et al. | 73/661 |
| 5,811,821 | 9/1998 | Alexander et al. | 250/440.11 |

FOREIGN PATENT DOCUMENTS

| | | | |
|---|---|---|---|
| 2256101 | 11/1992 | United Kingdom | 381/57 |

*Primary Examiner*—Huyen Le
*Attorney, Agent, or Firm*—Kenyon & Kenyon

[57] ABSTRACT

In a device for controlling the volume of a car radio as a function of driving noise, an acceleration sensor can be mechanically connected with the body of the motor vehicle, to generate a signal dependent on driving noise.

10 Claims, 2 Drawing Sheets

DEVICE FOR CONTROLLING THE VOLUME OF A CAR RADIO AS A FUNCTION OF DRIVING NOISE

FIELD OF THE INVENTION

The present invention relates to a device for controlling the volume of a car radio as a function of driving noise.

The noise level inside a motor vehicle is greatly dependent on the speed at which the vehicle is being driven in each instance. Since manual adjustment of the volume of a car radio to this noise level is considered bothersome, various methods for controlling the volume of a car radio as a function of the driving noise have already become known. From German Patent Application No. DE-A-33 38 413, a circuit arrangement for automatic noise-dependent volume control in a motor vehicle is known, where a signal which represents the interference in the car interior is generated using a microphone affixed in the car interior. To compensate the audio signal component in the microphone output signal generated by the loudspeaker signal, the loudspeaker input signal is subtracted from the microphone output signal in a summation circuit, so that a control value in the form of the interference noise level present in the vehicle interior is present at the output of the subtraction element.

From European Patent Application No. EP-A-0 246 772, an arrangement to attenuate body vibrations in motor vehicles is known, where the vibrations are caused, for example, by driving over uneven areas in the road. For this purpose, the body vibrations are detected using an acceleration-sensor, and the measurement signal is evaluated in a computer unit. The chassis shock absorbers of the vehicle are tuned, as a function of the measurement signal, in such a way that body vibrations are reduced.

It is the task of the present invention to improve the derivation of a signal dependent on driving noise, which is used to control the volume of a car radio as a function of driving noise, in such a way that measures to remove wanted signal components from the control signals are not necessary.

This task is accomplished, according to the invention, in that an acceleration sensor can be mechanically connected with the body of the motor vehicle, to generate a signal dependent on driving noise. In this connection, it can be provided, as a simplification, that the acceleration sensor essentially measures vertical accelerations.

The present invention is based on the recognition that driving noises are transferred into the interior (passenger space) of the motor vehicle mainly as structure-borne noise. These noises are, in particular, engine noises and tire noises. Measures to remove the wanted signal component from the signal obtained using the acceleration sensor are not needed for the device according to the present invention.

The device according to the present invention demonstrates the additional advantage, particularly if the acceleration sensor is arranged in the car radio, according to a further development, that no further installations are required within the vehicle itself—such as laying lines and installing a microphone.

Preferably, it is provided, for the device according to the invention, that the acceleration sensor is rigidly connected with the housing of the car radio. An advantageous development of the device according to the present invention consists of the fact that the acceleration sensor demonstrates a signal band width of about 1 kHz. This covers the entire spectral range required for masking structure-borne noise, and commercially available acceleration sensors can be used, such as the acceleration sensor Type ADXL50 from the company Analog Devices.

Although the device according to the present invention is also suitable, for example, for volume control independent of frequency, better results are obtained with frequency-dependent masking, for which it is provided, according to a further development of the device according to the present invention, that an output of the acceleration sensor can be passed to a multi-channel equalizer, via a signal processing circuit with a known, predetermined algorithm, along with the audio signals generated by the car radio, the outputs of which equalizer are connected with control inputs of the signal processing circuit and with inputs of end stages.

DETAILED DESCRIPTION OF THE INVENTION

The same parts are indicated with the same reference symbols in the different figures.

Figure 1:
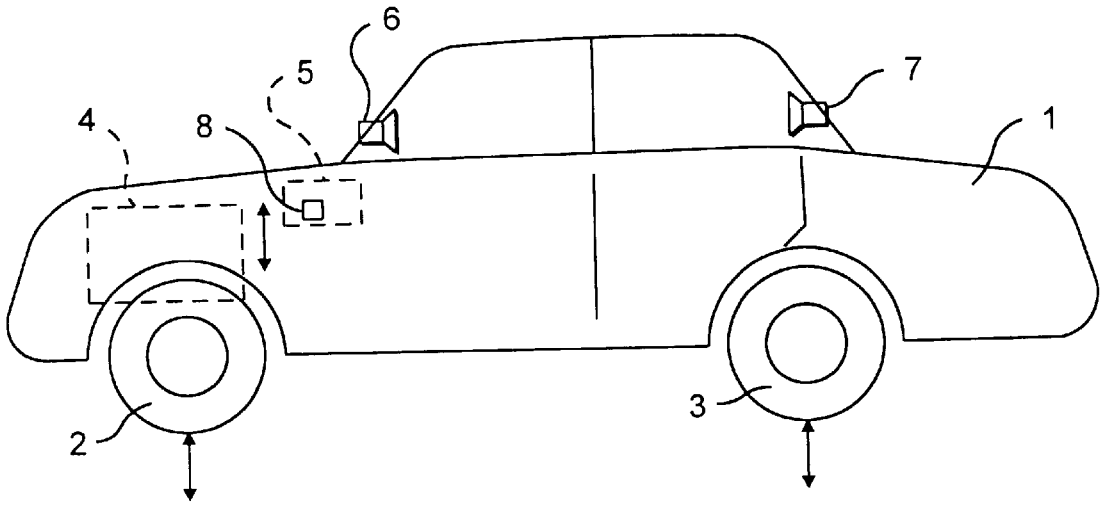
FIG. 1 shows a motor vehicle with a device according to the present invention.

FIG. 1 schematically shows a car with a body 1, front wheels 2, rear wheels 3, an engine 4 and a car radio 5, the loudspeakers 6, 7 of which are only indicated. Double arrows illustrate the forces which act on the wheels and the forces which proceed from the engine and act on the body. It is evident that forces with a vertical effect make up a significant component of the structure-borne noise. An acceleration sensor 8 is therefore arranged in such a way that it detects the vertical acceleration.

Figure 2:
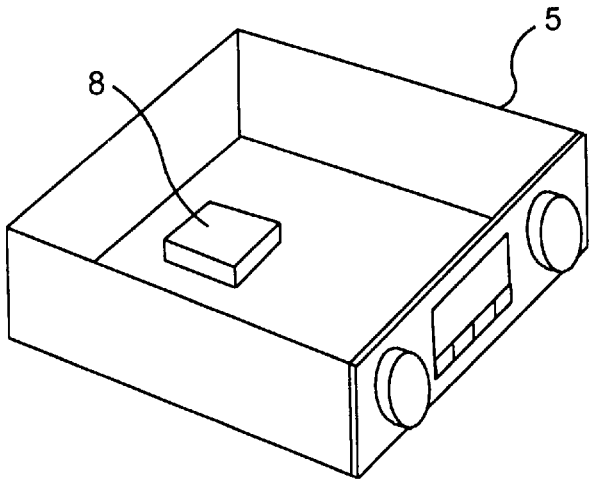
FIG. 2 shows a car radio with an acceleration sensor arranged on the bottom housing wall.

According to FIG. 2, the acceleration sensor 8 is arranged, for example, on the base plate of the car radio 5. It can therefore be connected with the circuitry of the car radio in simple manner.

Figure 3:
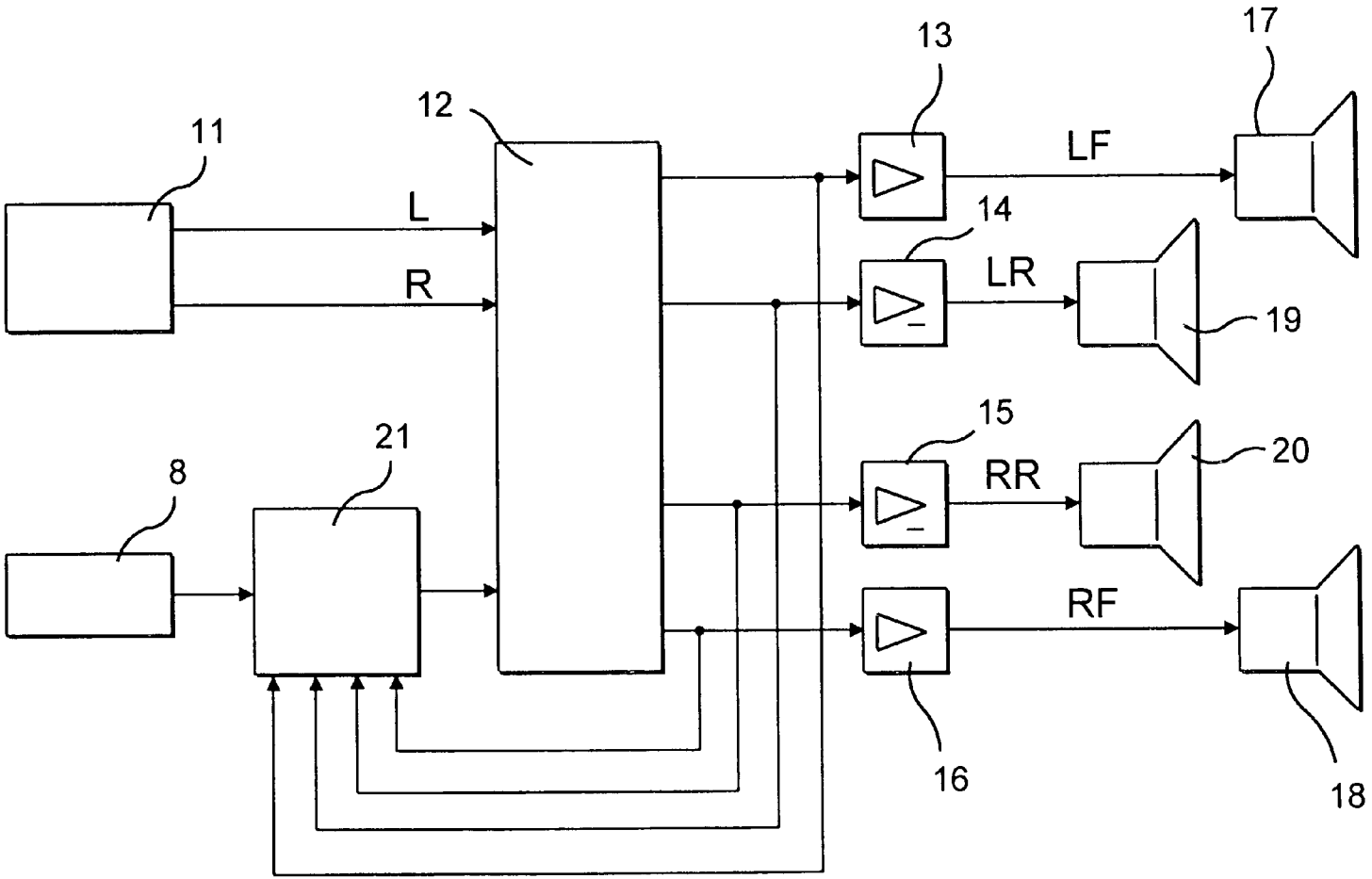
FIG. 3 shows a schematic of a device according to the present invention.

FIG. 3 shows a schematic of a device according to the present invention, in which the parts of the car radio which are not specifically adapted to the invention, such as the receiver section, and cassette player, stereo decoder, and low frequency amplifier, if present, are comprised in a circuit 11 as the low frequency source. The low frequency source 11 passes the audio signals L and R to a multi-channel equalizer 12, which is connected with four end stages 13, 14, 15, 16 for four loudspeakers 17, 18, 19, 20 via four outputs. In this connection, LF and RF stand for the signals for the left front and right front loudspeakers, while the signals LR and RR indicate the signals for the left rear and right rear loudspeakers. The end stages 14 and 15 each invert the output signal, as indicated by a minus sign.

The output signal of the acceleration sensor 8 is passed, for example, to a signal processing circuit 21, which can be controlled by the output signals of the multi-channel equalizer 12. The signal processing circuit 21 processes the output signal of the acceleration sensor and the output signals of the multi-channel equalizer with known algorithms. The output signal of the signal processing circuit is then passed to the multi-channel equalizer 12, in order to control amplification of the audio signals L and F in several different frequency bands.

What is claimed is:

1. A device for controlling a volume of a car radio of a motor vehicle as a function of a driving noise, comprising:

an acceleration sensor detecting the driving noise which is provided into an interior of the motor vehicle as a structure-borne noise and generating a sensor signal which relates to the structure-borne noise, the acceleration sensor being mechanically connected to a body of the motor vehicle; and a signal processing circuit receiving the sensor signal and controlling the volume of the car radio disposed in the motor vehicle as a function of the sensor signal.

2. The device according to claim 1, wherein the acceleration sensor measures vertical accelerations.

3. The device according to claim 1, wherein the acceleration sensor is disposed in the car radio.

4. The device according to claim 3, wherein the acceleration sensor is rigidly connected with a housing of the car radio.

5. The device according to claim 1, wherein the acceleration sensor demonstrates a signal band of about 1 Khz.

6. A device for controlling a volume of a car radio of a motor vehicle as a function of a driving noise, comprising:

an acceleration sensor detecting the driving noise which is provided into an interior of the motor vehicle as a structure-borne noise and generating a sensor signal which relates to the structure-borne noise, the acceleration sensor being mechanically connected to a body of the motor vehicle; mechanically connected to a body of the motor vehicle;

a low frequency source having an audio signal output;

a multi-channel equalizer having a plurality of inputs and a plurality of outputs, the plurality of outputs being connected to a plurality of end stages, at least one of the plurality of inputs receiving the audio signal output from the low frequency source; and a signal processing circuit connected to at least one of the plurality of inputs of the multi-channel equalizer and to the plurality of outputs of the multi-channel equalizer, the signal processing circuit receiving the sensor signal end controlling the volume of the car radio as a function of the sensor signal and the outputs of the multi-channel equalizer via a pre-determined algorithm.

7. The device according to claim 6, wherein the acceleration sensor measures vertical accelerations.

8. The device according to claim 6, wherein the acceleration sensor is disposed in the car radio.

9. The device according to claim 6, wherein the acceleration sensor is rigidly connected with a housing of the car radio.

10. The device according to claim 6, wherein the acceleration sensor demonstrates a signal band of about 1 Khz.

* * * * *

UNITED STATES PATENT AND TRADEMARK OFFICE

CERTIFICATE OF CORRECTION

PATENT : 6,031,918

DATED : February 29, 2000

INVENTOR(S) : Djahanyar CHAHABADI

It is certified that error appears in the above-identified patent and that said Letters Patent is hereby corrected as shown below:

Column 1, line 41, change "... the invention..." to -- the present invention --.

Column 4, line 2, delete "mechanically connected to a body of the motor vehicle:".

Column 4, line 15, change "... end..." to -- and --.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*